US005275299A

United States Patent [19]

Konrad et al.

[11] Patent Number: 5,275,299

[45] Date of Patent: Jan. 4, 1994

[54] CLOSURE DEVICE FOR AN IN PARTICULAR EVACUABLE CYLINDRICAL HOUSING

[75] Inventors: Franz Konrad, Regau; Günther Pakanecz; Manfred Lederer, both of Kremsmünster, all of Austria

[73] Assignee: C. A. Greiner & Söhne Gesellschaft mbH, Kremsmünster, Austria

[21] Appl. No.: 963,941

[22] Filed: Oct. 20, 1992

Related U.S. Application Data

[63] Continuation of Ser. No. 573,008, filed as PCT/AT89/00032, Apr. 4, 1989, abandoned.

[30] Foreign Application Priority Data

Apr. 15, 1988 [AT] Austria ..... A972/88
Dec. 23, 1988 [AT] Austria ..... A3141/88

[51] Int. Cl.[5] ..... B65D 53/00

[52] U.S. Cl. ..... 215/341; 215/354; 215/356; 215/364; 215/360; 215/332; 215/DIG. 3; 215/247; 215/261; 215/12.2

[58] Field of Search ..... 215/341, 354, 356, 357, 215/364, 360, 332, DIG. 2, DIG. 3; 215/12.2

[56] References Cited

U.S. PATENT DOCUMENTS

| | | | |
|---|---|---|---|
| 1,037,272 | 11/1907 | Lindsay | 215/364 X |
| 1,989,218 | 1/1935 | Villanyi | 215/364 |
| 2,696,319 | 12/1954 | Menefee | 215/364 |
| 2,934,231 | 4/1960 | Bramming | 215/364 X |
| 3,017,050 | 1/1962 | Barr, Sr. et al. . | |
| 3,059,798 | 10/1962 | Darmstadt et al. | 215/364 X |
| 3,088,615 | 5/1963 | Mumford et al. . | |
| 3,709,395 | 1/1973 | Brennan et al. . | |
| 3,937,211 | 2/1976 | Merten . | |
| 3,991,895 | 11/1976 | Thornton | 215/354 X |
| 4,387,821 | 6/1983 | Geiger | 215/332 X |
| 4,646,925 | 3/1987 | Nohara | 215/12.2 X |
| 4,772,558 | 9/1988 | Hammann | 215/247 X |
| 4,919,985 | 4/1990 | Asai et al. | 215/12.2 X |
| 5,000,804 | 3/1991 | Nugent | 215/12.2 X |

FOREIGN PATENT DOCUMENTS

| | | | |
|---|---|---|---|
| 142679 | 12/1980 | Denmark . | |
| 0102851 | 3/1984 | European Pat. Off. . | |
| 0129029 | 12/1984 | European Pat. Off. . | |
| 0150172 | 7/1985 | European Pat. Off. . | |
| 580962 | 10/1976 | Fed. Rep. of Germany . | |
| 3119908 | 2/1988 | Fed. Rep. of Germany . | |
| 2025381 | 1/1980 | United Kingdom | 215/331 |

*Primary Examiner*—Allan N. Shoap
*Assistant Examiner*—Paul A. Schwarz
*Attorney, Agent, or Firm*—Collard & Roe

[57] ABSTRACT

A closure device for a front side of an in particular evacuable cylindrical housing comprises a cap surrounding said front side of said housing with a front wall in which a borehole is arranged. A sealing device is arranged between the borehole and an internal cavity of the cylindrical housing. The cap is connected to the sealing device and/or the cylindrical housing by means of a coupling device.

11 Claims, 10 Drawing Sheets

Figure 1:
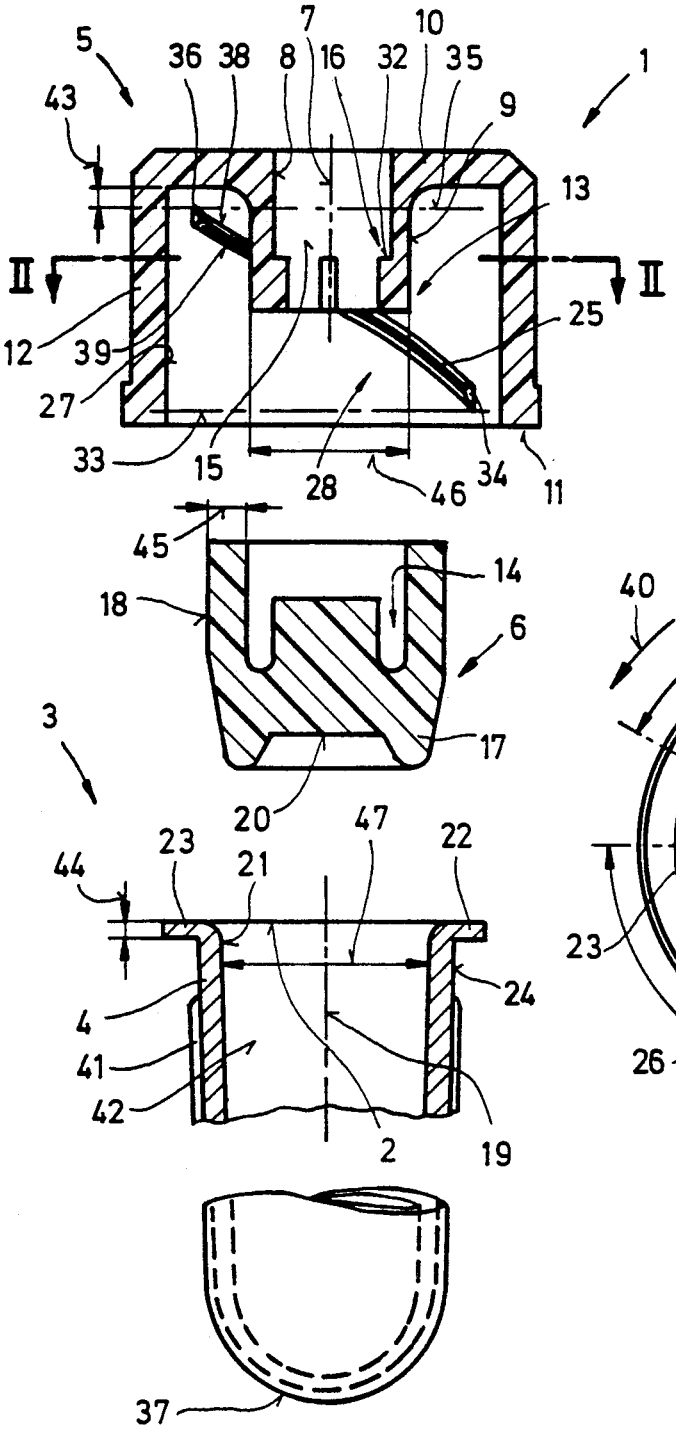

FIG.8
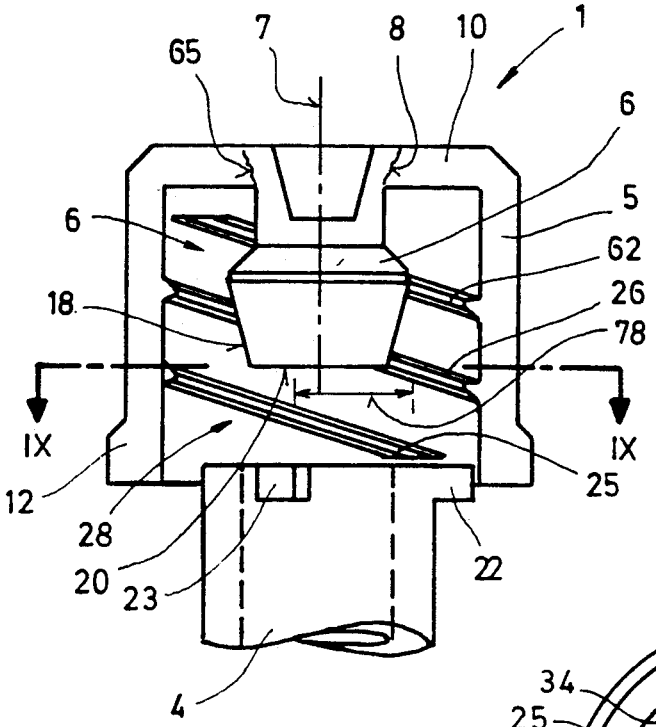
FIG.9
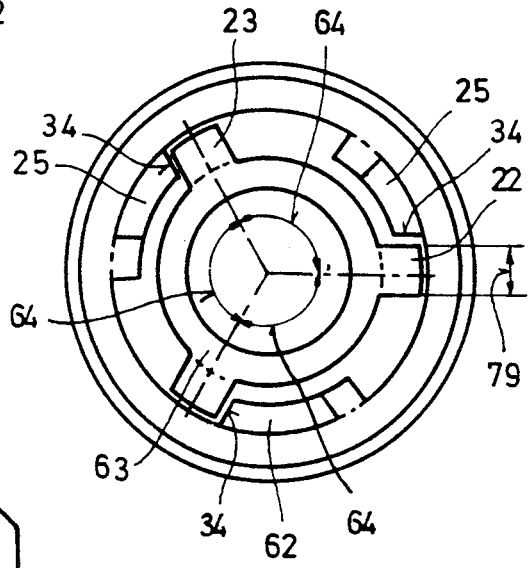
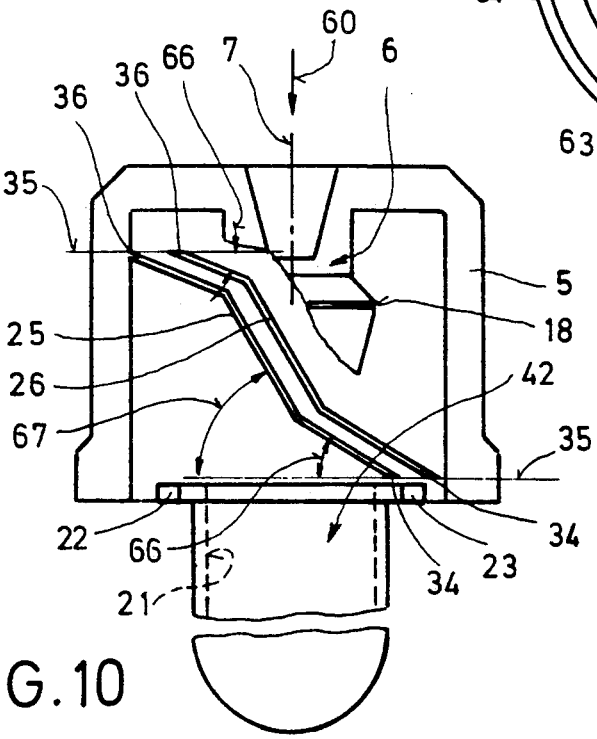
FIG.10

FIG.11
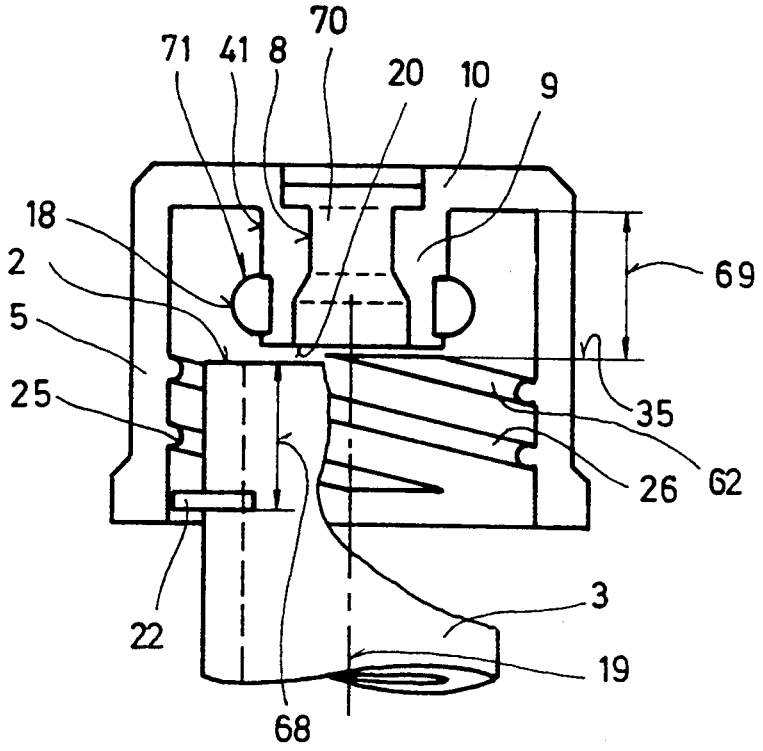
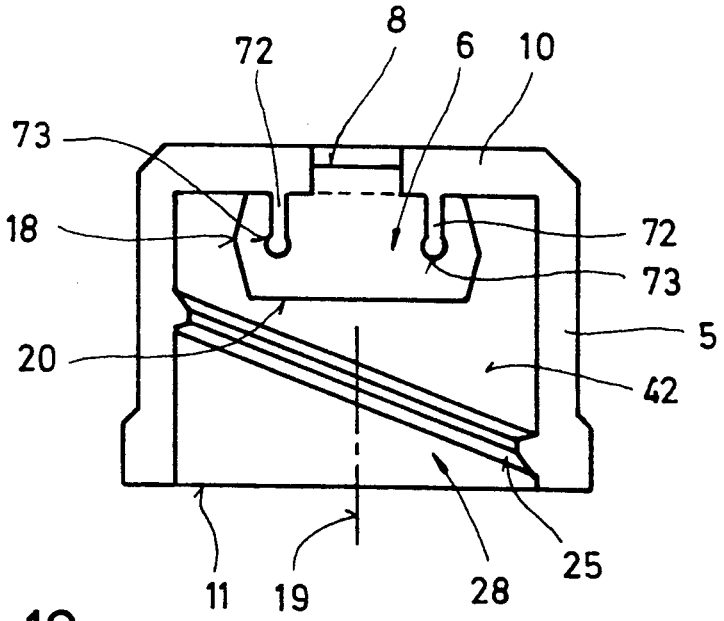
FIG.12

CLOSURE DEVICE FOR AN IN PARTICULAR EVACUABLE CYLINDRICAL HOUSING

This is a continuation of our copending application Ser. No. 07/573,008, filed as PCT/AT89/00032, Apr. 4, 1989, now abandoned.

The invention relates to a closure device for a front side of an in particular evacuable cylindrical housing, comprising a cap enclosing the front side of the cylindrical housing, a front wall in which a bore is arranged, and a sealing device arranged between the bore and an inner space of the housing.

According to Austrian Patent Specification 379,069 of the same Applicant, a closure device for a cylindrical housing, in particular a blood-sample tube, has already been disclosed, which closure device is formed by a cap enclosing an open front side of the cylindrical housing. Arranged in the cap is a bore and provided between the latter and an inner space of the housing is a sealing device. Provided in the bore or in a tubular extension adjoining this bore are projecting portions which protrude beyond the surface of the cap and are covered by the sealing device. Depending on the adhesion force between the sealing device and the cylindrical housing, opening of the closure device without the escape of the medicines or body fluids contained therein could not always be ensured.

In addition, a plurality of closure devices for cylindrical housings, in particular for keeping medicines or body fluids, have been disclosed in which one-piece or multi-piece caps have been used with sealing devices. Thus it is known to close the open front sides of the cylindrical housing with stopper-like sealing devices which are fixed in turn in these enclosing caps, as, for example, according to U.S. Pat. Nos. 4,465,200 and 4,205,754 and 4,089,432, European Patent Specification 129,029 and European Offenlegungsschrift 257,498. A disadvantage in these closure devices is that partly very high forces have to be applied in the longitudinal direction of the cylindrical housing in order to overcome the adhesion forces between the sealing device and the cylindrical housings so that medicines or body fluids stored in these housings can escape time after time and thus chemical burns or infections, in articularduring the processing of blood infected with Aids, can occur. It is also a disadvantage in these closure devices that, when the sealing device is pierced through with a needle to remove the contents, unintentional opening of the closure device can occur.

The object of the present invention is to create a closure device for a cylindrical housing, in particular a blood-sample tube, with which a reliable gas-tight closure of the inner space of a cylindrical housing of this type can be maintained even for a prolonged storage period and which enables careful opening but also prevents sudden escape of the contents from the cylindrical housing. In addition, a relative movement between the closure device and the cylindrical housing in the longitudinal direction of the same is to be effectively prevented.

This object is achieved when the cap is connected via a coupling device to the sealing device and/or the cylindrical housing. This measure, which appears simple, ensures in a surprisingly simple manner that the opening movement need not take place solely in the longitudinal direction of the cylindrical housing, as a result of which the suction effect as well as the tensile force exerted on the closure device can be reduced. Thus the sealing device can be prevented from coming suddenly out of the cylindrical housing, and thus the risk of the contents, such as a medicine or blood, spurting out when the cylindrical housing is opened can be reduced.

In a further embodiment it is also possible for the sealing device to have an encircling sealing surface, allocated to an inner bearing surface of the cylindrical housing, and a sealing surface running perpendicularly to the longitudinal axis of the cylindrical housing. This ensures that a gas-tight seal of the open front end both relative to the encircling shell or the inner surface of the cylindrical housing and also perpendicularly to the longitudinal axis of the cylindrical housing is obtained with the sealing device.

Furthermore, it is also possible for the sealing surfaces encircling in an annular manner and running perpendicularly to the longitudinal axis of the cylindrical housing to be arranged on different sealing elements of the sealing device, which results in the basic requirement that, by the displacement of the sealing surfaces during a release of the seal between the inner surface and the encircling sealing surface, spurting of the contents out of the cylindrical housing can be prevented by the sealing surface running perpendicularly to the longitudinal axis of the cylindrical housing.

In a further embodiment, provision is made for the sealing element having the encircling sealing surface to form a part of the cap, as a result of which the cap itself can be used both for sealing and also for mechanically fixing on the cylindrical housing, and the sealing device or the sealing element having the sealing surface running perpendicularly to the longitudinal axis of the cylindrical housing can be geared to the additional medical requirements necessary, such as adequate gas tightness even after a hollow needle or the like has been pierced through.

Furthermore, however, it is also possible for the coupling device to be formed by coupling arms, protruding beyond the sealing device, and coupling openings arranged in the cap, and for the coupling arms to be engaged into the coupling openings, as a result of which a motionally fixed connection is created between the sealing device and the cap both in the longitudinal direction of the longitudinal axis of the cylindrical housing and also in the peripheral direction. This enables the cap to be released from the cylindrical housing by a combined longitudinal and rotational movement in the manner of a helix. In particular, the relatively high adhesion, existing after prolonged transport, owing to the rotationally fast connection between the cap and the sealing device in the cylindrical housing, can be secured by turning the sealing device relative to the cylindrical housing and consequently the cap can be removed with less expenditure of force in the direction of the longitudinal axis of the cylindrical housing.

It is, however, also possible for the coupling device to be formed by coupling arms, protruding beyond the front wall of the cap in the direction of the open front end of the same, and coupling openings arranged in the sealing device. This solution has the advantage that a cap is normally made of a plastic which is more resistant or can be loaded to a greater extent so that, in this embodiment, higher torsional and tensile forces can be reliably transmitted to the sealing device. In this arrangement, the lower loading capacity of the usually elastic sealing device in tension or compression can be compensated by the transmission surfaces between the driving member and the sealing device being produced with a correspondingly larger cross-section.

In another embodiment variant, provision is made for the coupling device to be formed by a tubular extension which adjoins the bore in the cap and extends parallel to the cylindrical cap shell in the direction of the open front end of the cap, for an annular groove, arranged concentrically to the extension, to be arranged in the sealing device, for an average diameter of the groove and an average diameter of the extension to be approximately the same size, and for the extension to be inserted into the groove. Consequently, only a single sealing device which has both the encircling sealing surface and the sealing surface running perpendicularly to the longitudinal axis is enough. Furthermore, it is possible, owing to the tubular extension, to produce a desired pretension or surface pressure between the encircling sealing surface and the inner surface of the cylindrical housing if an outside diameter of the sealing device is larger than an inside diameter of the cylindrical housing. By the strength of the tubular extension or its elasticity, the contact pressure in the radial direction between the sealing device and the inner surface of the cylindrical housing can be determined and maintained for a prolonged period even if the material of the sealing device contracts on account of the higher elasticity.

However, it is also of advantage that the sealing device having the encircling sealing surface is formed by an O-ring which is arranged on the tubular extension, adjoining the bore in the front wall of the cap, on the side facing the cap shell, preferably in a groove provided in the extension, since the adhesion forces, which can cause the sealing surface to adhere firmly to the inner surface of the cylindrical housing, are smaller on account of the smaller contact area. Nonetheless, a very sound seal, even against the escape of gas, can be obtained.

Furthermore, it is possible for the encircling sealing surface to be formed by a plurality of O-rings arranged one behind the other in the direction of the longitudinal axis of the cap, as a result of which the gas tightness can be geared to the particular requirements and produced with less additional expenditure.

However, it is also possible for the tubular extension, on its side remote from the front wall of the cap, to be closed with a sealing cap which forms the sealing device and is provided with the encircling sealing surface and the sealing surface running perpendicularly to the longitudinal axis, as a result of which a simple construction of the cap and also the sealing device is obtained.

In another embodiment variant, provision is made for a difference between a minimum inside diameter of the cap shell and a maximum outside diameter of the tubular extension to be less than a wall thickness of the cylindrical housing, as a result of which adequate gearing of the tubular extension on the inner surface of the cylindrical housing and thus an adequate seal against both the escape of fluid and also the escape or ingress of gases is obtained.

Furthermore, it is advantageous when a difference between the minimum inside diameter of the cap shell and a maximum outside diameter of the encircling sealing surface is less than the wall thickness of the cylindrical housing, as a result of which, by means of the predetermined difference, it is simple to establish the bearing pressure of the sealing surfaces on the inner surface of the cylindrical housing. At the same time, however, the desired gas and fluid tightness can also be ensured by this bearing pressure.

In a further development, provision is made for the bore and/or the tubular extension to be closed by a sealing device designed as a stopper, as a result of which sealing devices of simple configuration are enough.

In another advantageous refinement, provision is made for locking extensions to be arranged on the cap or the tubular extension and/or the sealing device in the area of contact between the cap and the sealing device. The locking extensions ensure in a simple manner a positive-locking motional connection between the sealing device and the cap so that, even if the sealing device and cap are only fitted together, the sealing device, during movements of the cap, is driven along both in the direction of the longitudinal axis of the cylindrical housing and also in the peripheral direction.

In another embodiment variant, provision is made for the locking extensions to be formed by ribs which are distributed over the periphery of the inner surface of the tubular extension, protrude into the inner space and run parallel to the longitudinal axis of the cap. By the sealing device being compressed to a greater extent in the area of the ribs when being pushed into the tubular extension, better bracing of the sealing device in the tubular extension is obtained and the ribs dig into the surface of the sealing device so that the latter is driven along satisfactorily in the direction of the longitudinal axis of the cap. However, by the longitudinal fluting, formed by the ribs, on the inner surface of the tubular extension, the sealing device is also driven along in the peripheral direction in an improved manner, since the protruding ribs act like a tooth system and thus reliably drive the sealing device along via this tooth system when the cap is turned in the peripheral direction.

In a further design, provision is made for the ends of the ribs to be of sharp-edged configuration, as a result of which the sharp-edged ends act like barbs and consequently ensure that the sealing device is driven along satisfactorily with the cap even under high tensile forces.

It is also advantageous in this respect when the locking extensions are designed in a barb shape, since thereby the position of the sealing device can be exactly maintained not only, for example, when pulling out the cap but also when pushing in and closing the cylindrical housing.

In another embodiment, provision is made for the ribs, on the side facing the front wall of the cap, to be provided with a front face running roughly perpendicularly to the longitudinal axis of the cap, as a result of which the ribs, in particular when the sealing device is being pulled out of the cylindrical housing, dig especially effectively into the sealing device and thus reliable removal from the cylindrical housing is achieved.

However, it is also advantageous when the locking extensions are arranged on the surface of the tubular extension facing the cap shell, since, owing to the surface pressure between the inner surface of the cylindrical housing and the tubular extension when the sealing device is being pressed into or pulled out of the cylindrical housing, the sealing device and the locking extensions are firmly pressed against one another so that it is not possible for the locking extensions to slip accidentally out of the sealing device.

Furthermore, however, it is also possible for the locking extensions to be arranged on the front side of the tubular extension facing the open front end of the cap, since the locking extensions can dig especially effectively into the interior of the sealing device, in particular when a cap-shaped sealing device is used.

In another embodiment, provision is made for the coupling device to comprise at least two webs, running roughly spirally on the inner side of the cap shell, and two guide extensions protruding at the periphery beyond the surface of the cylindrical housing in the area of an open front end, and for the webs to extend from a transverse plane, running perpendicularly to the longitudinal axis of the cap and nearer to the front wall, to a transverse plane further away from said transverse plane, and for the start of the two webs and the ends of the two webs to be arranged so as to be offset from one another in the peripheral direction by an opening angle of about 180°, and for guide extensions to be arranged so as to be offset on the periphery of the cylindrical housing at an angle of about 180°. This solution ensures in a surprisingly simple manner that the opening action, at least at the start and end, has a considerable component in the peripheral direction, as a result of which a sliding or spiral opening action occurs, and thus abrupt pulling-out or opening between sealing device and cap and thus the risk of the medicine or the body fluid spurting out are reliably prevented.

In another embodiment variant, provision is made for a distance between the front wall and the transverse plane nearer to the latter to be greater than a length of the guide extensions in the direction of the longitudinal axis of the cap or the cylindrical housing. This ensures, in an advantageous manner, that the guide extensions disengage from the grooves formed between the webs and can be turned as desired in the peripheral direction without the closure device being opened. Only when the cap is moved away from the cylindrical housing in the longitudinal direction of the axis of the latter do the webs or the grooves located between them come into engagement with the guide extensions, and then the closure device can be opened by turning further. A safety closure which reliably prevents unintentional opening of the cylindrical housing is thereby achieved in a simple manner.

In another design, provision is made for the distance between the front wall of the cap and the transverse plane nearest to this front wall to correspond to the length of the guide extensions parallel to the longitudinal axis of the cap or the cylindrical housing plus a distance between these guide extensions and the open front side of the cylindrical housing. It is thereby possible, even when the guide extensions are not arranged directly in the area of the front end of the cylindrical housing, to achieve that, in the closed state, the guide extensions can be freely turned in the peripheral direction without the closure device being opened unintentionally.

In another advantageous further development, provision is made for a distance between the open front side of the cylindrical housing and the encircling sealing surface, when guide extensions of the cylindrical housing are arranged in the area of the transverse plane at a further distance from the front wall, to be less than a distance between the two transverse planes in which the webs start and end, which ensures in a simple manner that, after the guide extensions have been displaced, the cylindrical housing is reliably closed gastight or opened. Thus, no further examination is required on the part of the operator; on the contrary, it is guaranteed that, after closing, the gas-tight closure is obtained when the cap is fully turned freely relative to the cylindrical housing.

In another embodiment, however, it is also possible for a pitch angle of the webs to vary over their longitudinal path, as a result of which the path of the webs and the opening movement can be simply adapted to the type of sealing surfaces or sealing devices used, for example O-rings, stoppers or caps, or the like.

In another further development, provision is made for a width of the guide extensions in the peripheral direction of the cylindrical housing to be less than a groove width between the webs in a transverse plane running perpendicularly to the longitudinal axis of the cap, since jamming during opening and closing between the cylindrical housing and the cap can thereby be prevented.

In another further design, provision is made for three webs to be provided on the inner side of the cap, which three webs run roughly spirally and whose start and end are offset in the peripheral direction by about 120° in the two transverse planes distanced from one another, and for three guide extensions allocated to the grooves between the individual webs to be arranged on the outer side of the cylindrical housing in such a way as to be distanced from one another in the peripheral direction by about 120°. By the use of spiral webs running parallel to one another, a three-point mounting of the cap on the cylindrical housing is achieved,so that a virtually central opening and closing operation of the cap can be ensured.

Furthermore, it is of advantage when the sealing device having the sealing surface running perpendicularly to the cap is formed from a silicone rubber or another gas-tight rubber, e.g. bromobutyl rubber or flexible plastic, since, for seals of this type, there is already many years of experience with regard to medicines and compatibility with body fluid, and in addition corresponding experience is available with regard to the dimensioning in order to achieve gas tightness, on the one hand, and to permit piercing with hollow needles, on on the other hand.

Finally, it is also possible within the scope of the invention for the outer surface of the cylindrical housing, from a closed end of the cylindrical housing into an area of a bearing surface of the encircling sealing surface of the sealing device, to be coated with a gas-barrier layer. This ensures that the high degree of gas tightness which can be achieved with the closure device designed according to the invention can also be ensured in the remaining area of the cylindrical housing so that, on the whole, a long storage period of cylindrical housings of this type, filled with medicines or body fluids or evacuated, is possible.

In a further embodiment, it is also possible for the coupling device to be formed from at least one coupling part, motionally connected to the cap, and a coupling part, allocated to said coupling part and motionally connected to the sealing device, and to have in particular locking extensions to prevent rotation and/or displacement in the longitudinal direction of the cylindrical housing. Consequently, the sealing device of the closure device can resist an axial load as occurs during piercing with a needle of larger diameter. Furthermore, the fluid stored in the tube can be removed from the tube, e.g. drawn off, without the closure device having to be opened.

Furthermore, it is of advantage when the coupling part of the sealing device preferably forming the locking extension is formed by a flange-like shoulder which protrudes beyond a cylindrical sealing surface of the sealing device in the area of a front face approximately by the wall thickness of the cylindrical housing, since thereby an inside diameter of the tubular cap can roughly correspond to the outside diameter of the cylindrical housing, as a result of which the cap is satisfactorily guided during a closing and/or opening movement.

In another embodiment variant, provision is also made for a plurality of annular-segment-shaped coupling parts, preferably four, of the tubular cap, which are arranged so as to be diametrically opposite and at a distance from one another on the inner periphery of the cap and to project beyond this inner periphery, to be allocated to the coupling parts of the sealing device. Fitting of the sealing device into the cap is facilitated by the coupling parts arranged at a distance apart on the periphery. This embodiment is especially of advantage where automatic assembly methods are used for closing the housing.

However, it is also of advantage when the coupling parts of the tubular cap are formed as extensions which project beyond the cylindrical inner surface of the cap in the direction of a longitudinal axis and form groove-shaped locating areas which mount the coupling parts of the sealing device formed by the flange like shoulder. Consequently, the sealing device, in a surprisingly simple manner, can be mounted in the cap in such a way that even greater axial forces, as occur when the sealing device is removed from the opening of the cylindrical housing, can be exerted without further fastening means having to be provided in the cap for the sealing device.

However, it is also possible for the coupling parts of the sealing device to be formed by recesses distributed over its periphery and arranged at a distance from one another, and for extensions arranged so as to be diametrically opposed and serving as coupling parts to be allocated to these recesses. A reliable motional connection of the sealing device in the closure device is achieved by the coupling parts being arranged so as to be at a distance apart and distributed on the periphery.

However, it is also of advantage when the groove-shaped locating area forming the coupling part of the cap extends over an angle of less than 360°. A non-rotational connection of the sealing device in the cap is thereby achieved in a surprisingly simple manner.

In another embodiment variant, however, it is also possible for a flange-like shoulder serving as the coupling part of the sealing device to extend over an angular range which is less than 360° and is preferably slightly smaller than an angular range of the groove of the cap forming the coupling part. Thus joining the sealing device to the cap can be facilitated.

However, it is also possible for the coupling parts of the sealing device and/or the cap to be formed by extensions which project in particular beyond a peripheral surface, are directed towards one another in the radial direction and are offset from one another in the peripheral direction. In this arrangement, a satisfactory connection, facilitating assembly, between the sealing device and the cap is achieved according to the principle of a dog coupling.

However, it is also of advantage when the extensions are arranged in the direction of the longitudinal axis in two perpendicular planes distanced from one another, and the extensions arranged in the two arranged planes are offset from one another in the peripheral direction. It is thereby possible for the tools for the production of such workpieces provided with extensions to be of simpler design.

However, it is also possible for the coupling parts arranged in the area of an opening of the cap on the front side to be formed by a plurality of finger-like extensions which are distributed, preferably uniformly, over the periphery, are arranged parallel to the longitudinal axis of the cap and are also elastic in the radial direction. Owing to the elastic adjustability of the locking extensions designed like catches, sealing devices which are made, for example, of composite materials having a highly elastic core and a resistant annular casing can also be used in a surprisingly simple manner.

However, it is also of advantage when the finger-like extensions are integrally formed in one piece on the cap, as a result of which no additional parts are necessary for mounting the sealing device in the cap. The cap can thus be produced inexpensively in a single operation, e.g. by injection moulding in multiple arrangement in injection moulds.

In another embodiment, it is also possible for the finger-like extensions to be connected to the tubular cap via flexible supporting members, e.g. metal springs. Consequently, the elasticity of the finger-like extensions can be simply adapted to specific application requirements by the selection of the spring force of the metal springs.

However, it is also possible for the coupling part to be formed by a top part which is placed onto the cap and is mounted in the cap via a snap device. Consequently, interchangeability of the sealing device after removal of the top parts mounted in the snap device becomes possible in a surprisingly simple manner.

Furthermore, however, it is also possible for the top part to have an opening which is smaller than a diameter of the sealing device, as a result of which the top part forms the locking extension for the sealing device in the axial direction. Furthermore, by the opening in the top part, it is possible to pierce through the sealing device with, for example, a needle to remove the medicine or body fluid from the housing.

In another embodiment variant, it is also possible for the coupling part to be formed by an in particular C-shaped ring which is elastic in the radial direction and has a width which is larger than a depth of a groove which is provided on the side of the cap facing the sealing device and runs in a plane arranged perpendicularly to the longitudinal axis. The C-shaped spring ring represents a surprisingly simple component for the effective mounting of the sealing device against undesired axial displacements relative to the cap. Furthermore, it permits the use of a hard casing arranged on the periphery of the sealing device. In this embodiment, it is also possible to exchange the sealing device in a surprisingly simple manner.

However, it is also of advantage when the sealing device is formed from a composite material, and a highly elastic core area is preferably arranged in an annular casing having high rigidity. The advantage of the design of the sealing arrangement made of a composite material is that a core area of the cylindrical sealing device can be designed to be highly elastic, as a result of which there is reliable tightness even after the sealing device has been pierced through with a needle. At the same time, the hard casing of the sealing device can ensure a satisfactory fixing and mounting of the sealing device between the locking extensions arranged in the cap or integrally formed on the cap.

Furthermore, it is of advantage when the sealing device, in its core area, has a hardness of preferably 43° Shore, and the area surrounding the core, in particular the coupling parts, has a hardness greater than 43° Shore. In this design with a graduated hardness between core and casing, the high elasticity in the core area is obtained which permits the elastic closing of the sealing device after piercing. In addition, by the harder design of the coupling parts, the fixing of the sealing device against the effects of forces in the axial and radial direction is guaranteed in a surprisingly simple manner.

Figure 2:
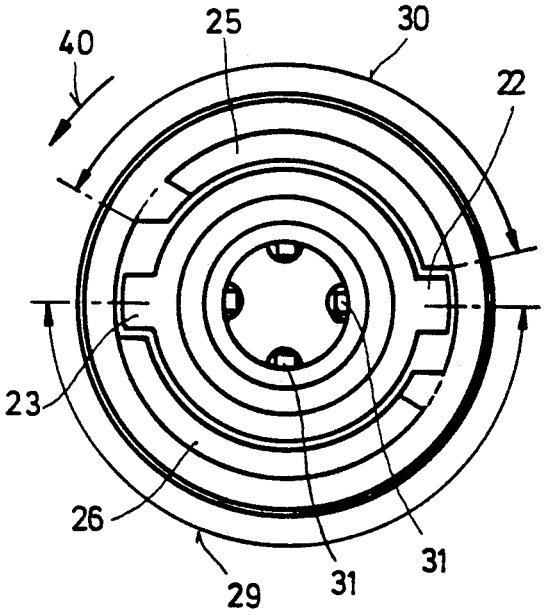
Figure 3:
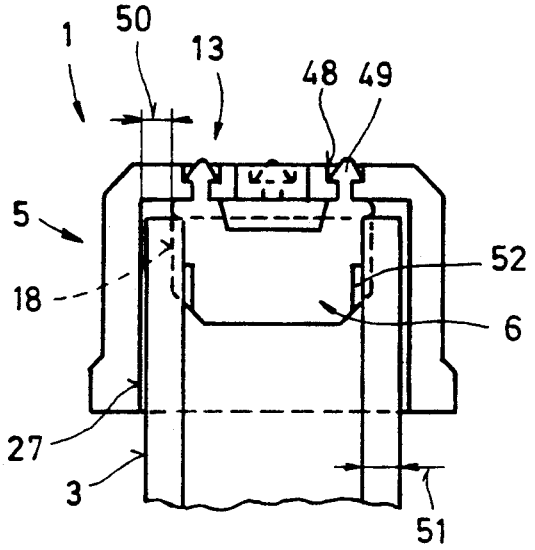
Figure 4:
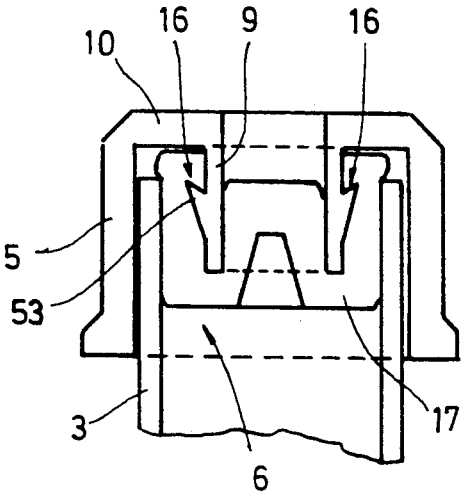
Figure 5:
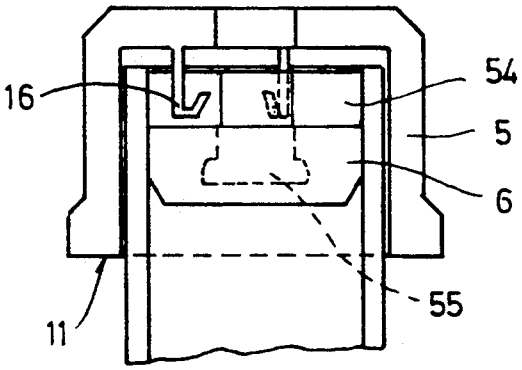
Figure 6:
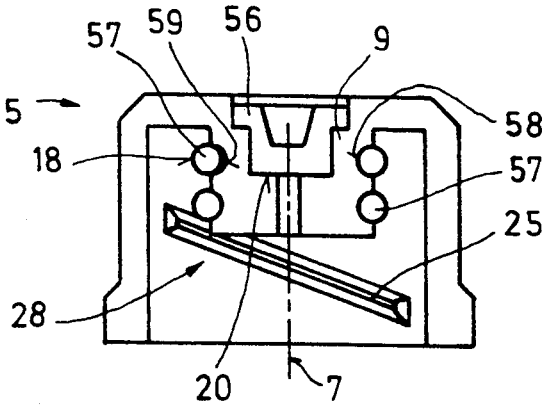
Figure 7:
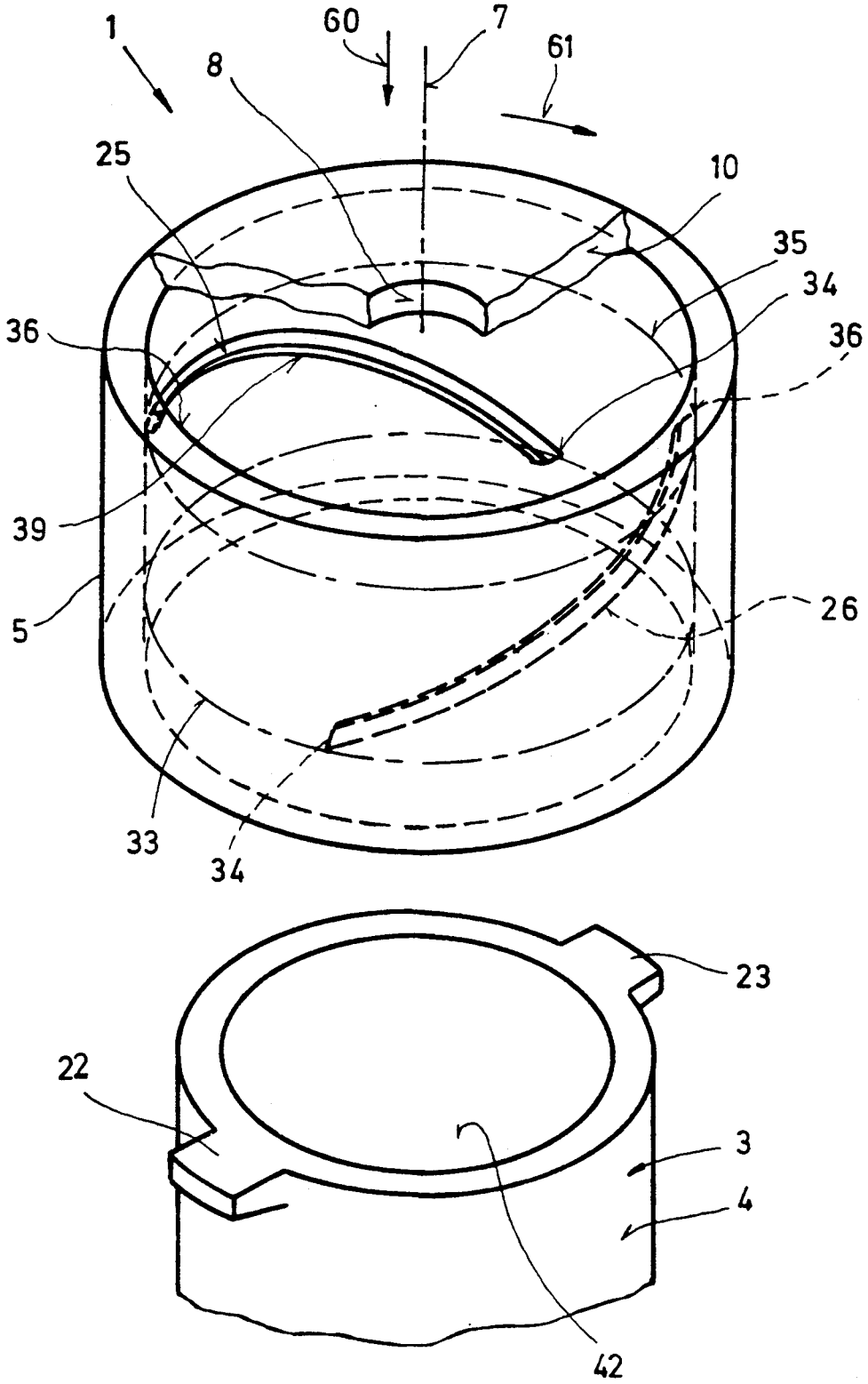
Figure 13:
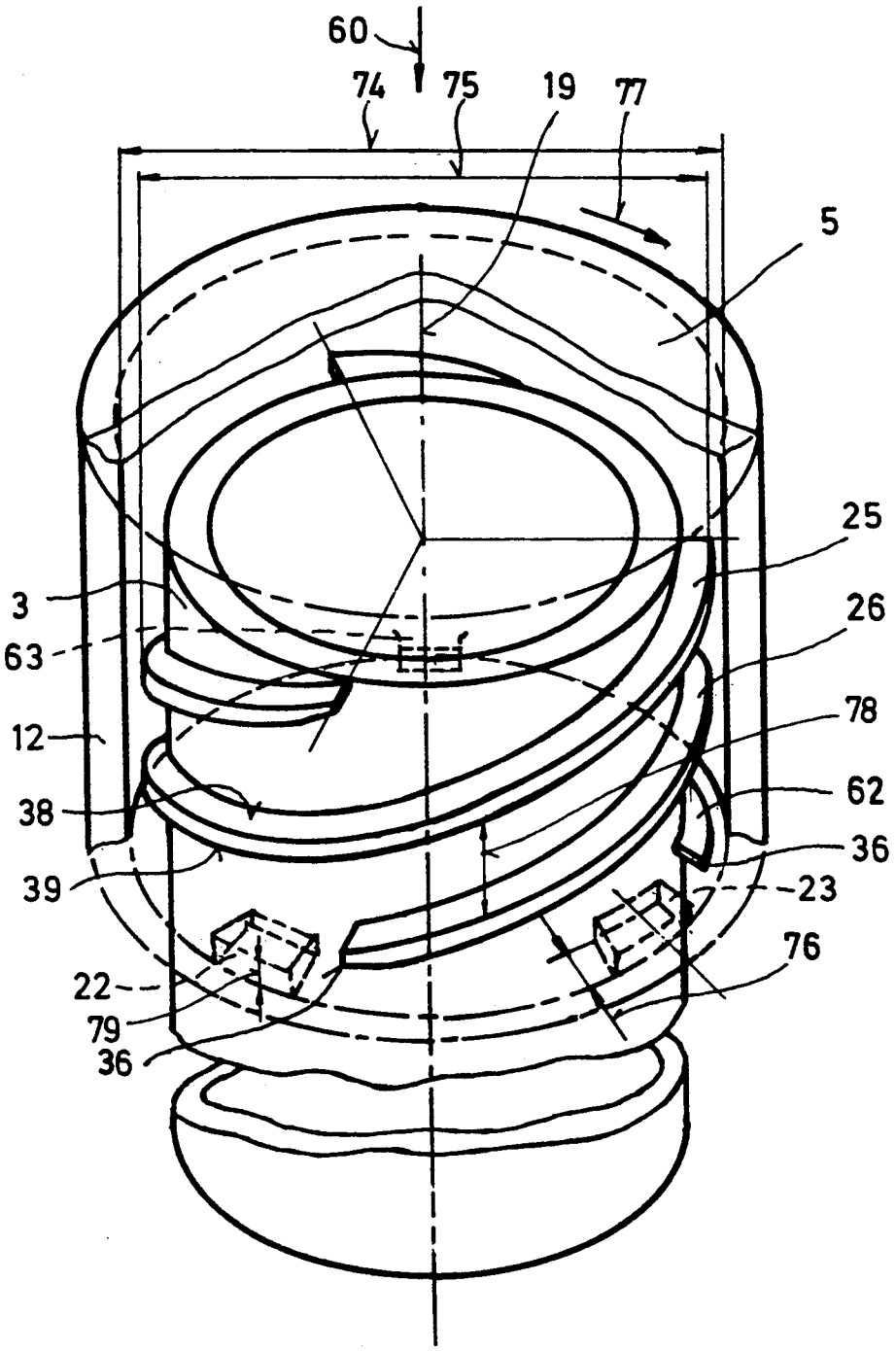
Figure 14:
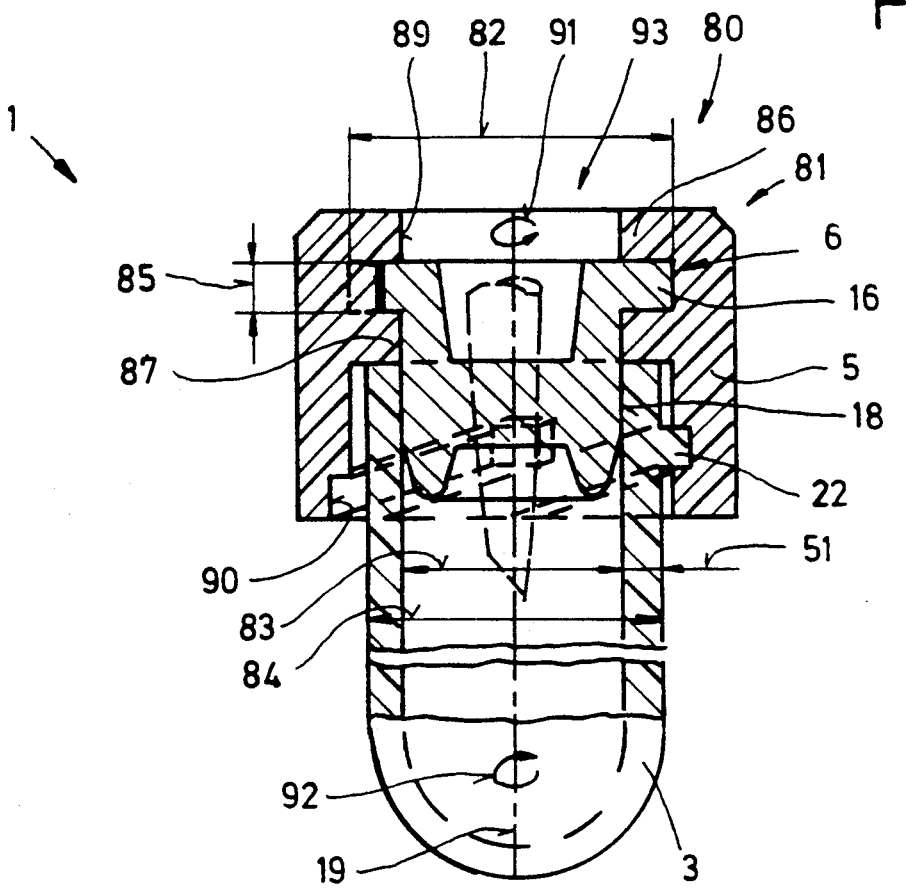
Figure 15:
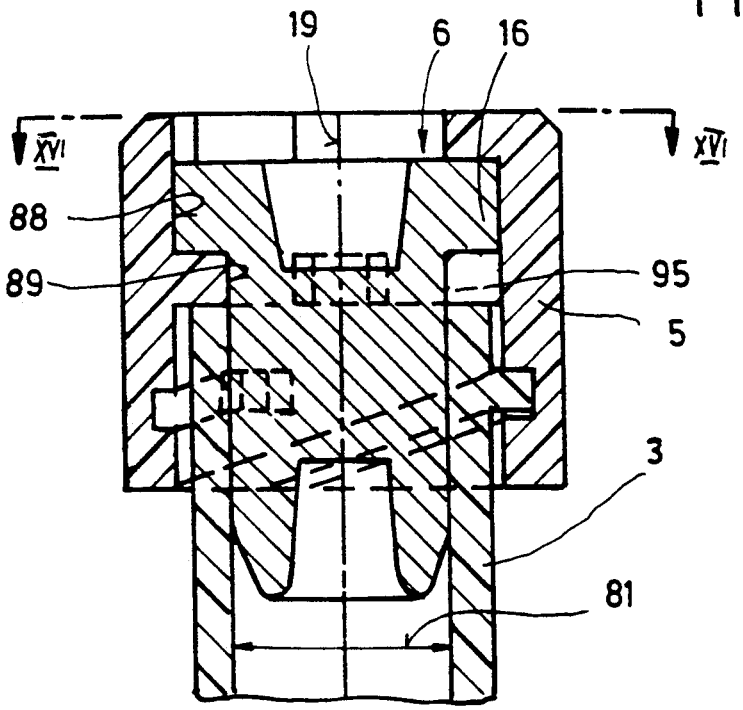
Figure 16:
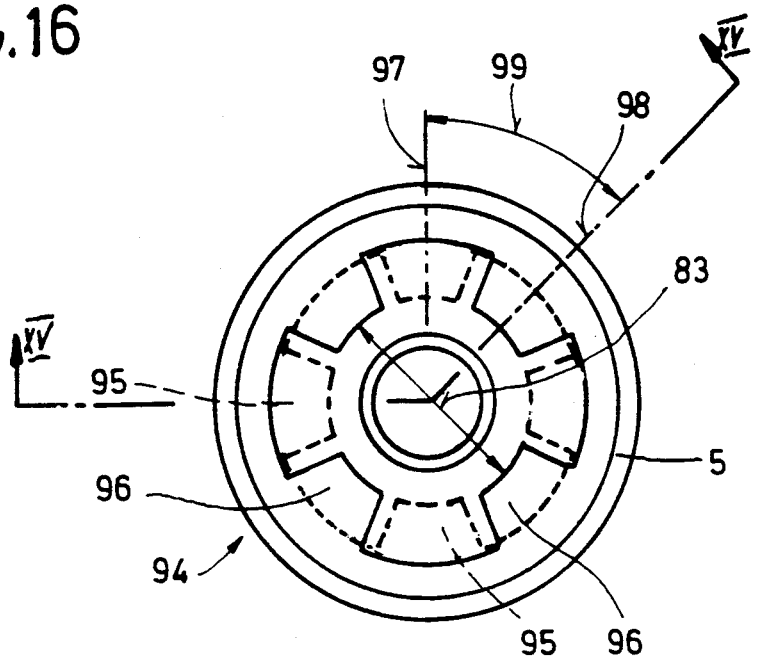
Figure 17:
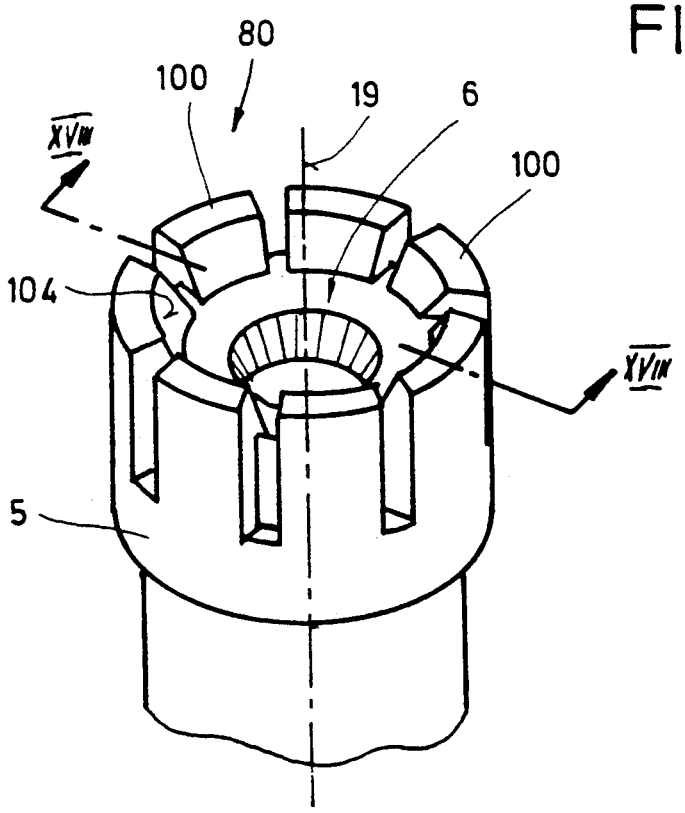
Figure 18:
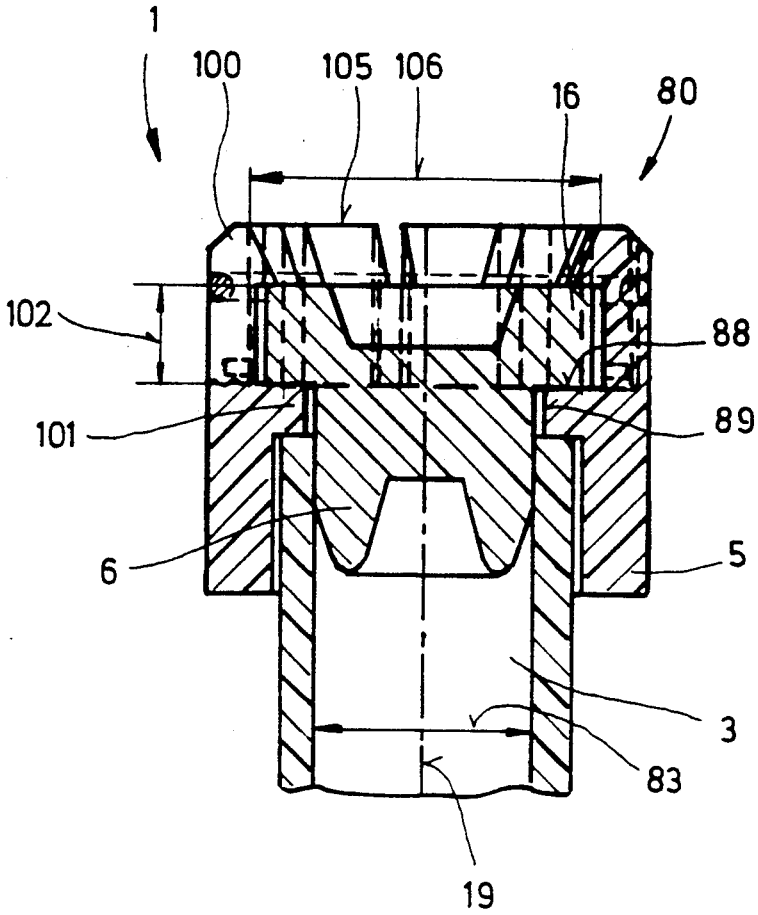
Figure 19:
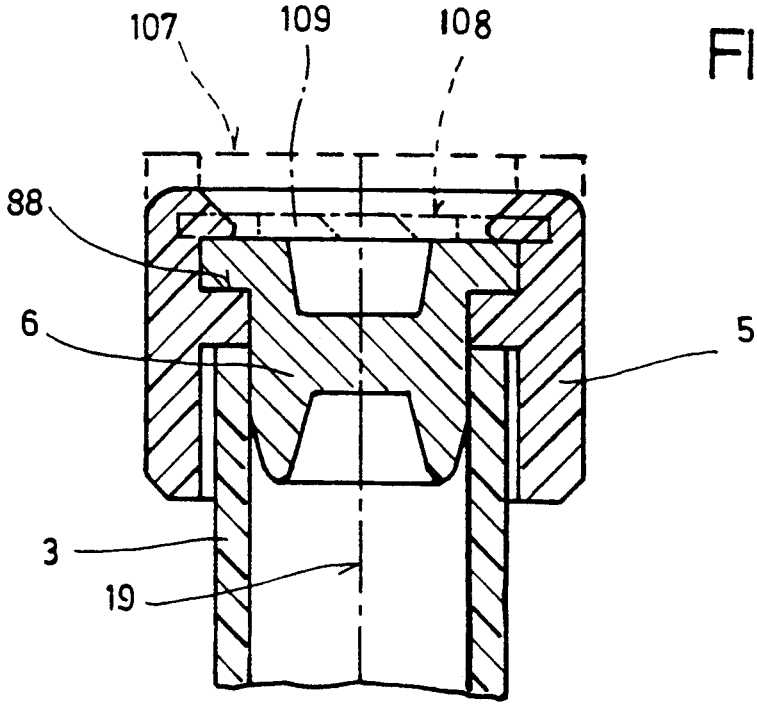
Figure 20:
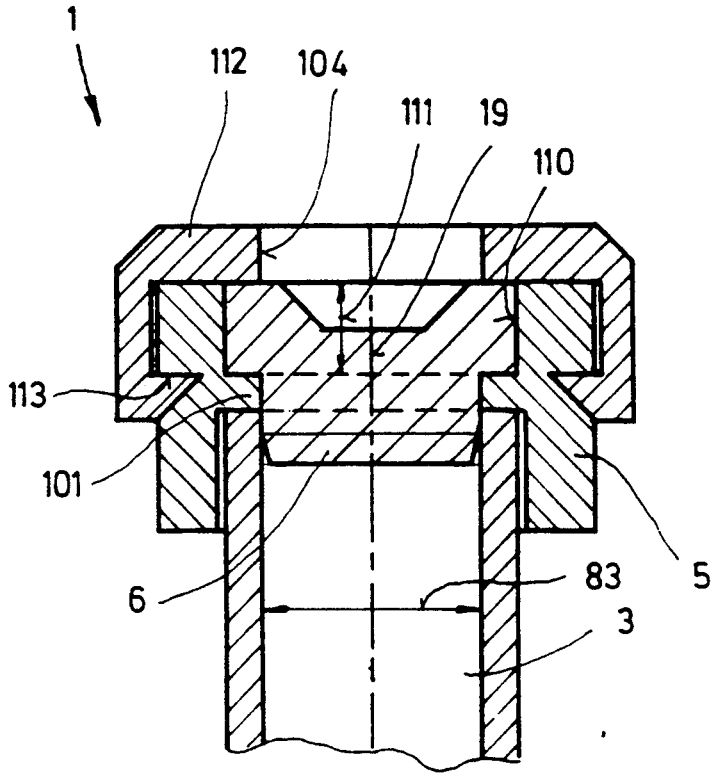
Figure 21:
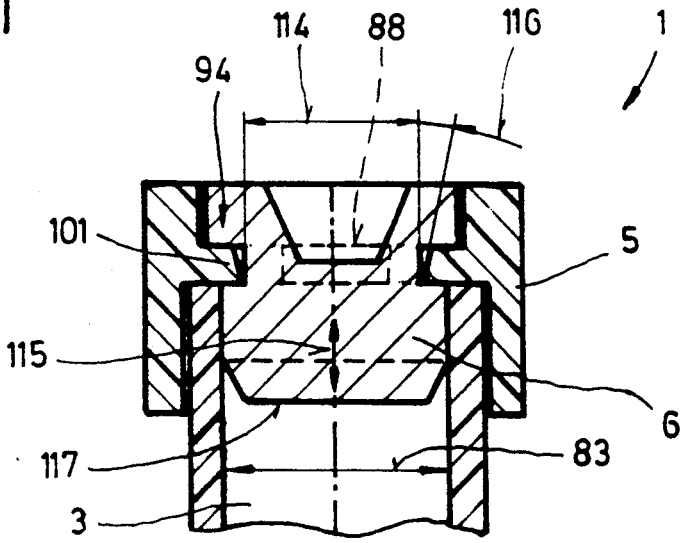

To better understand the invention, it is described in greater detail below with reference to exemplary embodiments shown in the drawings, in which:

FIG. 1 as an exploded drawing in sectional side view,shows a closure device, designed according to the invention, of a cylindrical housing, having coupling devices designed according to the invention and arranged between the cap and the sealing device;

FIG. 2 shows the closure device according to FIG.1 in sectional plan view along the lines II—II in FIG.1;

FIG. 3 in sectional side view, shows another embodiment variant of a coupling device between the cap and a sealing device with reference to a closure device according to the invention;

FIG. 4 shows a further design of a closure device in sectional side view having a coupling device constructed according to the invention between cap and sealing device;

FIG. 5 in sectional side view, shows a further embodiment variant of a closure device, designed according to the invention, having a coupling device between the cap and the sealing device;

FIG. 6 in sectional side view, shows a further embodiment of a closure device according to the invention;

FIG. 7 in diagrammatic representation, partly sectioned, shows a closure device designed according to the invention, having a coupling device between the cap and the cylindrical housing, with cap lifted from the cylindrical housing;

FIG. 8 in sectional side view, shows an embodiment of coupling device according to the invention between a cap and a cylindrical housing;

FIG. 9 shows the coupling device in sectional plan view along lines IX—IX in FIG.8;

FIG.10 in sectional side view, shows another embodiment of the coupling device according to the invention, having webs running with different pitch;

FIG. 11 in sectional side view, shows another embodiment variant of a closure device designed according to the invention, having the coupling device allocated to it between the cap and the cylindrical housing;

FIG.12 in sectional side view, shows another design of a closure device according to the invention, having a coupling device between the cap and the sealing device and the cylindrical housing;

FIG.13 shows another embodiment of a closure device according to the invention;

FIG.14 in sectional side view, shows a further design of a closure device having a coupling device constructed according to the invention between cap and sealing device;

FIG.15 in sectional side view, shows a further embodiment variant of a closure device designed according to the invention, having a coupling device between the cap and the sealing device;

FIG.16 shows the closure device according to FIG.15 in plan view;

FIG.17 in diagrammatic representation, shows a closure device designed according to the invention having a coupling device between the cap and the sealing device;

FIG.18 shows the closure device according to FIG.17 in sectional side view;

FIG.19 in sectional side view, shows a further embodiment variant of a closure device according to the invention with a coupling device;

FIG.20 in sectional side view, shows a further embodiment variant of a closure device with a top part;

FIG.21 shows another embodiment of a closure device having a coupling device between cap and sealing device.

FIG.1 shows a closure device 1 for closing an open front side 2 of a cylindrical housing 3. This cylindrical housing 3 can be used, for example, as a blood-sample tube 4. To close the open front side 2, the closure device 1 consists of a cap 5, enclosing this open front side 2, and a sealing device 6. The cap 5 is provided with a bore 8 running concentrically to a longitudinal axis 7. Adjoining this bore in this exemplary embodiment is a tubular locking extension 9 which extends from a transverse end wall 10 in the direction of an open front end 11 of the cap 5 and thus parallel to a cap shell 12, tubular locking extension 9 defining a bore 8.

The coupling device 13 between the cap 5 and the sealing device 6 consists of a tubular extension 9, a concentric annular groove 14 arranged in the sealing device 6, and also locking extensions 16 arranged on an inner surface 15 of the tubular extension 9. In this exemplary embodiment, the sealing device 6 is designed as a sealing cap 17 and has an encircling sealing surface 18 and a pierceable transverse sealing element 20 axially aligned with bore 8 and running perpendicularly to the longitudinal axis 7 of the cap 5 and also to a longitudinal axis 19 of the cylindrical housing 3. The encircling sealing surface 18 mates with an inner cylindrical bearing surface 21 in the interior of the cylindrical housing 3. Furthermore, this cylindrical housing 3 is provided with guide extensions 22,23 which protrude on the periphery beyond a surface 24 of the cylindrical housing 3 and are arranged in the area of the open front side 2 of the same. These guide extensions 22,23 are arranged together with webs 25,26 on the concentric inner surface 27 of the cap shell 12 and run spirally. They form a coupling device 28 between the cap 5 and the cylindrical housing 3.

FIG.2 shows that the guide extensions 22,23 are arranged so as to be distributed over the periphery of the cylindrical housing 3 approximately by an angle 29 of about 180°. The webs 25 and 26 extend over an opening angle 30 which is less than 180°. Before the cylindrical housing 3 is closed with the closure device 1, the sealing device 6 is inserted into the cap 5. To this end, the sealing cap 17 is pushed onto the extension 9 so that the latter penetrates into the groove 14. When being pushed onto the extension 9, the sealing cap 17 is deformed when pushed over the locking extensions 16 designed as ribs 31. As apparent, these ribs 31, on their end facing the end wall 10, are provided with end faces 32 running approximately perpendicularly to the longitudinal axis 7. Consequently, the sealing cap 17, which can be formed, for example, of rubber, in particular bromobutyl rubber, silicone rubber or the like, slips over the sharp-edged front faces 32 when being pushed in, and in the process the locking extensions 16 fasten like barbs in the sealing cap 17. This ensures that, under high tensile forces exerted via the cap 5, the sealing cap 17, even if it is held by high adhesion forces between the sealing surface 18 and the bearing surface 21 in the cylindrical housing 3, can be pulled out of the latter without being released from the cap 5. Furthermore, as can be better seen from FIG.2, the sealing cap 17 is deformed like a toothed wheel by the ribs 31 arranged so as to be distributed over the periphery of the inner surface 15. Consequently, relatively high torsional forces can also be transmitted to the sealing cap 17 with the cap 5, without the sealing cap 17 rotating relative to the cap 5. Even if the sealing cap 17 adheres firmly to the bearing surface 21 during insertion owing to residues of medicines or body fluids, this design of the coupling device 17 now enables the sealing cap 17 to be released from the cylindrical housing 3 by a combined rotational and longitudinal movement in the direction of the longitudinal axis 19.

In order to facilitate this opening movement, the closure device 1 also has a further coupling device 28, which, however, need not necessarily be arranged in conjunction with the described embodiment of the cap 5. The function of this coupling device 28 is such that the webs 25,26 run onto the guide extensions 22,23 when the cap 5 is pushed in the direction of the longitudinal axes 7 and 19 onto the open front side of the cylindrical housing 3 while being appropriately turned clockwise. The cap is then pushed onto the cylindrical housing 3 by the combined rotational and longitudinal movement on account of the guidance of the webs 25,26 along the guide extensions 22 and 23. This displacement movement is continued until the guide extensions 22,23 are displaced from a lower transverse plane 33, in which a start 34 of the webs 25,26 is located in each case, into the area of an upper transverse plane 35 in which the ends 36 of the webs 25 and 26 respectively are located.

The cap 5 is opened or pulled off the cylindrical housing 3 in exactly the opposite manner, and in fact the webs 25 and 26 are removed from a closed end 37 of the cylindrical housing 3 by lifting the cap 5 so that the guide extensions 23 and 22 now no longer rest on an upper side 38 of the webs 25,26, but these webs, with an underside 39, rest on the guide extensions 22,23. By further turning of the cap 5 anti-clockwise—arrow 40—the cap 5 is now pulled off the cylindrical housing 3 by a combined rotational and pressure movement. This combined rotational and pressure movement has the effect that the sealing surface 18 is not pulled off the bearing surface 21 at exactly the same time but rather obliquely so that the cross-section of the front side 2 of the cylindrical housing 3 is not released suddenly but in a sliding manner. A vacuum or positive pressure contained in the cylindrical housing is thus discharged gradually at the start in the course of the opening movement so that spurting out of medicines or body fluid can be held back as far as possible. Furthermore, the guidance of the cap 5 in a direction perpendicularly or transversely to the longitudinal axis 7 or 19 prevents, even for a large opening force, that the latter can be applied only parallel to the longitudinal axis 7,19 when the sealing surface 18 separates from the bearing surface 21, so that the risk of sudden separation of these two surfaces is reduced. In the known closure devices, this sudden separation comes about in particular when the tensile force exerted on the cap 5 has been so high that the vacuum contained in the cylindrical housing has been overcome suddenly or the adhesion forces present have been exceeded. This can result in an instantaneous relative movement between cap and cylindrical housing, which usually leads to the contents of the cylindrical housing spurting out.

The cylindrical housing 3 can be made of glass or an appropriate plastic, for example polyethylene terephthalate or its copolymers. In order to obtain an adequate gas tightness of this cylindrical housing, it is also possible, inter alia, to apply to the outer surface 24 a gas-barrier layer 41 which can be formed, for example, from a polyvinylidene chloride. This gas-barrier layer is to be applied to the cylindrical housing 3 in the direction towards the open front side to such an extent that the bearing surface 21 or sealing surface 18 and this gas-barrier layer 41 overlap. By the sealing cap 17, in this exemplary embodiment, being formed in one piece and comprising the encircling sealing surface 18 and the perpendicular sealing surface 20, this sealing cap 17 at the same time also forms the gas barrier for an inner space 42 of the cylindrical housing 3.

To enable the cap 5 to be fully turned freely after it has been firmly mounted onto the cylindrical housing 3, a distance 43 between the front wall 10 and the transverse plane 35 nearer to it is made larger than a length 44 of the guide extensions 22,23 parallel to the longitudinal axis 19 of the cylindrical housing 3.

As can be further seen from the diagrammatic representation in particular in FIG.1, a thickness 45 of the annular ring of the sealing cap 17 located between the groove 14 and the sealing surface 18 is greater than half the difference between an outside diameter 46 of the extension 9 and an inner diameter 47 of the cylindrical housing 3. Since an outside diameter of the groove 14 essentially corresponds to the outside diameter 46 of the extension 9, the sealing cap 17 cannot give way to the inside when it is pressed into the cylindrical housing 3. The oversize of the sealing cap 17 resulting from the greater thickness 45 therefore has to be accommodated by an elastic deformation of the sealing cap 17, as a result of which a correspondingly high surface pressure is built up between the sealing surface 18 and the bearing surface 21, which also enables the inner space 42 to be closed gas-tight for a prolonged period.

FIG.3 shows an embodiment variant of the coupling device 13 in which coupling openings 48 are arranged in a cap 5 for closing a cylindrical housing 3. Engaging into these coupling openings 48 are coupling arms 49 which protrude upwards above the sealing device 6. The coupling openings 48, like the coupling arms 49 on the sealing device 6, are arranged so as to be distributed at the same angular distance over the periphery of the cap 5. When the sealing device 6 is released, a distance 50 between the sealing surface 18 and the inner side 27 of the cap 5 is smaller than a wall thickness 51 of the cylindrical housing 3. When the cap 5 is pushed onto the cylindrical housing 3, the sealing device 6, as shown in solid lines, is thereby compressed and deformed so that a gas-tight closure is produced between the inner space 42 and surrounding air. As shown further schematically, the sealing surface 18 of the sealing device 6 can be provided with longitudinal slots 52. These longitudinal slots 52 have the effect that air can already pass through them into the inner space 42 and a pressure compensation takes place before the sealing device 6 comes out of the cylindrical housing. If the sealing device 6 is then pulled completely out of the cylindrical housing, the medicine or the body fluid does not splurt over.

This arrangement of the longitudinal slots 52 can of course also be used in all other exemplary embodiments and sealing devices shown in connection with the present description and is not bound to the embodiment shown.

By the use of the coupling arms 49 engaged into the coupling opening 48, the sealing device 6 is firmly connected to the cap 5 both in the direction parallel to the longitudinal axis 7 of the cap and also in the peripheral direction.

Even with combined rotational and pulling movements, an exact motional connection between the cap 5 and the sealing device 6 is obtained and the opening or removal of the closure device 1 is thereby facilitated.

FIG.4 shows an embodiment variant in which the cylindrical housing 3 is again sealed by the interaction between the cap 5 and the sealing device 6. In this case, the cap 5 is provided with a tubular extension 9, as already shown, for example, with reference to the representations in FIGS.1 and 2. The sealing device 6 is pushed over the tubular extension 9 and is designed roughly like a sealing cap 17. Furthermore, the coupling device 13 between the cap 5 and the sealing device 6 comprises locking extensions 16 which are designed like barbs 53. Specifically, they essentially consist of points which are directed towards the front wall 10 of the cap 5 and which, when the sealing device 6 is pushed in the direction of the front wall 10 onto the tubular extension 9, bore their way into the interior of the sealing device 6 and thus unmistakably secure the position of the sealing device 6 relative to the cap 5.

FIG.5 shows another embodiment variant of the coupling device 13 between the cap 5 and the sealing device 6. Here, locking extensions 16 into which a coupling disk 54, whose anchoring means 55 is injected or poured into the sealing device 6, engages, are arranged on an end of the tubular extension 9 projecting in the direction of the open front end 11 of the cap 5. It is thereby possible, by pushing the coupling disk 54 onto the extension 9 and subsequently turning it, for the coupling disk 54 to be fixed in its position relative to the extension 9 both against movements in the longitudinal direction parallel to the longitudinal axis 7 and also in the peripheral direction.

FIG.6 shows an embodiment variant in which the sealing device 6 is formed by two different sealing elements 56 and 57. The sealing elements 57 form the encircling sealing surface 18, while the sealing element 56 forms the sealing surface running perpendicularly to the longitudinal axis 7. As schematically indicated, grooves 58, which mount the sealing elements 57 designed as O-rings, can be provided with transverse ribs 59 or a fluting so that, when they are clamped between the cylindrical housing 3 and the tubular extension 9 of the cap 5, they then turn along with the cap 5 when the latter is turned.

Furthermore, it is also apparent from this representation that the cap 5 is provided with webs 25,26 to enable a cylindrical housing 3 to be carefully opened and closed via this coupling device 28.

In FIG.7, a design of a coupling device 28 between a cap 5 and a cylindrical housing 3 is shown in diagrammatic representation. It is apparent from this representation that the start 34 of the webs 25,26 is arranged on a transverse plane 33, while the ends 36 are located on a transverse plane 35. The start of the web 25 or 26 and the end 36 are each offset from one another by about 180° in the peripheral direction of the cap 5. Allocated to the two webs 25 and 26 are guide extensions 22 and 23 which protrude beyond an outer surface 24 of the cylindrical housing 3, for example a blood-sample tube 4. If the cap 5 is now pushed along the longitudinal axis 7 in the direction of an arrow 60 onto the cylindrical housing 3 and in the process slightly turned, the guide extensions 22 and 23, after the cap has been pushed onto the cylindrical housing 3 up to the transverse plane 33, come into engagement with the webs 25 and 26. If the cap 5 is turned clockwise—arrow 61—it is moved with its front wall 10 closer and closer to the guide extensions 22,23, and in fact until the latter have passed the end 36 of the webs 25,26 in the area of the transverse plane 35. In this position, the cap 5 can now be turned as desired. As long as it is not removed from the cylindrical housing 3 and the guide extensions 22 and 23 come to bear on the underside 39 of the webs 25,26, the cap 5 cannot be removed. On the other hand, if the guide extensions 22,23 come to bear on the underside 39 of the webs 25,26 and if the cap 5 is turned anti-clockwise, thus against the arrow 61, the front wall 10 of the cap 5 is moved away from the guide extensions 22 and 23, i.e. the closure device 1 is opened. As already described in the above exemplary embodiments, the cap 5 also has a bore 8 through which access to the inner space 42 of the cylindrical housing 3 is possible by means of an injection needle or the like. However, the bore can be omitted where removal of the fluid is only to be possible after opening the cap 5. Likewise, via this bore 8 or in any other manner at all, the cap 5, according to the exemplary embodiments described above, can be coupled to a sealing device 6 with which an air-tight closure of the tubular housing is also possible.

FIGS.8 and 9 show an embodiment variant of a closure device 1 in which the coupling device 28 has three webs 25,26 and 62. As can now be seen from the overall view of FIGS.8 and 9, the webs 25,26 and 62 each extend over an angular range of approximately 270°. Allocated to each of the webs 25,26,62 is a guide extension 22,23 and 63 which is connected in one piece to the cylindrical housing 3, for example a blood-sample tube, or is integrally formed on the latter or is produced by special shaping, for example subsequent hot working. The individual guide extensions 22,23 and 63 are offset in the peripheral direction by an angle 64 of about 120°. The same also roughly applies to the start 34 of the webs 25,26 and 62. In this embodiment, the sealing device 6, which forms both the encircling sealing surface 18 and the sealing surface 20 running perpendicularly to the longitudinal axis 7, is connected to the cap shell 12 in a positive-locking manner. This positive-locking connection is achieved during the injection operation for producing the cap shell 12 having the front wall 10 by another plastic having highly elastic properties being injected into the mould to produce the sealing device 6. A fusion action consequently occurs between the two types of material in the area of a seam 65 indicated by a serrated line. It is of course also possible for the sealing device 6, after the cap 5 has been produced in a separate injection operation, to be injected or expanded into the bore 8 of the cap 5. Thus it is also possible, inter alia, for this sealing device 6 to be formed from a plastic foam, for example a polyvinylidene chloride foam or a polyurethane foam or the like. It is simply important for the plastic used to have an adequate gas tightness and elasticity in order to permit a gas-tight closure of the cylindrical housing 3 or the blood-sample tube 4.

FIG.10 shows an embodiment in which a cap 5 is again provided with a sealing device 6 integrally formed on it. Arranged in the cap 5 are webs 25,26 whose start 34 is arranged on a transverse plane 33 and whose ends 36 are arranged on a transverse plane 35. Unlike the embodiment variants described above, how ever, a pitch angle 66,67 of the webs 25,26 varies over their path. Thus, the pitch angle 66 runs in a relatively flat manner in the start and end area of the webs 25,26, i.e. approximately perpendicularly to the longitudinal axis 7 of the cap 5, whereas it runs very steeply between these areas, in other words virtually parallel to the longitudinal axis 7. A relatively short rotational angle is thereby achieved for opening and closing the cap 5, but with it being ensured in this case, too, that, before the sealing device 6 is finally pulled out of the blood-sample tube 4, movement of the cap 5 exclusively parallel to the longitudinal axis 7 is prevented until the encircling sealing surface 18 of the sealing device 6 has been released from the bearing surface 21 in the cylindrical housing. The pitch angle 66 as well as the length of the webs 25,26 are dimensioned in such a way that this separation of the sealing surface 18 from the bearing surface 21 is complete before the guide extensions 22,23 have reached the end 36 of the webs 25,26.

FIG.11 shows a further embodiment of the invention in which three webs 25,26 and 62 are arranged in a cap 5. The arrangement of webs as well as of their peripheral length over which these webs extend can take place as shown, for example, with reference to the representation in FIGS. 8 and 9. Allocated to the webs 25,26,62 arranged in the cap 5 are guide extensions of which only the guide extension 22 on the cylindrical housing 3 can be seen. This guide extension 22 is arranged parallel to a longitudinal axis 19 of the cylindrical housing 3 in such a way as to be removed by a distance 68 from a front side 2 of the cylindrical housing 3. This distance 69 corresponds to a distance 68 between the front wall 10 of the cap 5 and the transverse plane 35 or is slightly smaller. This ensures that, even when the transverse plane 35 is at a greater distance from the front wall 10, the encircling sealing surface 18 can be brought into engagement with the bearing surface 21 in the cylindrical housing 3 by a corresponding arrangement of the guide extensions 22,23,63. As further apparent from this representation, two different sealing elements 70,71 are arranged for producing the sealing surface 20 running perpendicularly to the longitudinal axis and for producing the encircling sealing surface 18. The sealing element 71 is here designed like a stopper which, by appropriate configuration of the bore 8 in the front wall 10, is prevented from falling out in both directions when a force is applied from outside. The sealing element 71 is expanded or sprayed, for example, on a tubular extension 9 which adjoins the bore 8. This expansion or spraying can be effected at the same time as the cap 5 is produced or also separately therefrom. During such a separation of the sealing surface 18 from the sealing surface 20 and the use of two different sealing elements, care has to be taken to ensure that the tubular extension 9 is also of a corresponding gas-tight design or is provided with a gas-barrier layer 41 so that ingress or escape of gas through the plastic of this part is adequately prevented.

FIG.12 shows an embodiment in which the coupling device for connecting the cap 5 to the sealing device 6, which in this case has both the encircling sealing surface 18 and the sealing surface 20 running perpendicularly to the longitudinal axis 19, is formed via coupling arms 72 which protrude from the front wall 10 of the cap 5 in the direction of its open front end 11 and engage in coupling openings 73 in the sealing device 6. The sealing device 6 is thereby connected immovably to the cap 5 when moving both in the direction of the longitudinal axis 19 and also in the peripheral direction. The inner space 42 is accessible via the bore 8 in the cap 5.

Indicated purely schematically in this embodiment is also the fact that a further coupling device 28 having webs 25,26 for locking the cap 5 on a cylindrical housing 3, for example a housing of a syringe, or on a blood-sample tube 4 can be provided.

It is of course also possible within the scope of the invention to use the details described with reference to the individual exemplary embodiments selectively in the different exemplary embodiments and to arrange caps 5 both with the coupling device 13 between the sealing device 6 and the cap 5 and with coupling device 28 between the cap 5 and the cylindrical housing 3 or the blood-sample tube 4 or a housing of a syringe or another vessel.

The two coupling devices 13 and 28 respectively can of course also be used completely separately from one another, even in each case only by themselves, on caps 5 or closures of this type for containers for accommodating medicines, foodstuffs, body fluids, cleansing agents or the like. In particular, the use of coupling devices of this type is advantageous wherever a gas-tight closure is to be obtained and there is the risk, on account of the gas-tight closure, of the contents spurting out, in particular during opening, and consequently contagion, infections or chemical burns can occur.

It is of course possible within the scope of the invention for the sealing device 6 or the sealing elements 56,57 or 70,71 to be connected to the cap 5 via a layer of adhesive. Furthermore, it is also possible, for example, in the other exemplary embodiments shown, for the coupling arms 72 to be adhesively bonded in the coupling openings 73 or for the coupling arms 49 to be adhesively bonded in the coupling openings 48.

Furthermore, FIG.13 shows an embodiment in which the webs 25 or 26 and 62 are arranged on the cylindrical housing 3. During the manufacturing operation for the cylindrical housing 3, the webs can be directly formed integrally into this cylindrical housing 3 or can be produced by subsequent thermal working.

The guide extensions 22,23 and 63 allocated to these webs 25,26 and 62 protrude inwards beyond the cap shell 12. In this arrangement, an inside diameter 74 of the cap shell 12 is greater than a maximum outside diameter 75 of the cylindrical housing 3 in the area of the webs 25,26 and 63.

A length 76 of the guide extensions 22,23 and 63 protruding inwards beyond the cap shell 12 is less than half a difference between the inside diameter 74 and the outside diameter 75. This ensures that the guide extensions 22,23,63 and the webs 25,26,62 overlap one another so that the guide extensions 22,23,63 can be guided along the webs 25,26 and 62.

The function of opening and closing the housing 3 with the closure device 1 in the exemplary embodiment shown is as follows:

The cap 5, with the guide extensions 22,23,63, is moved towards the cylindrical housing 3 by a movement in the direction of arrow 60, that is, in the direction of the longitudinal axis 19 of the cylindrical housing 3, and, with light application of force in the direction of the cylindrical housing 3, is turned in the direction of arrow 77. The guide extensions 22,23,63 thereby come to bear on the underside 39 of the webs 25,26,62. By a further turn in the direction of arrow 77, the cap 5 is pulled onto the cylindrical housing in the direction of arrow 60. If the ends 36 of the webs 25,26,62 have now been reached, the cap 5 can be turned further endlessly and, with its guide extensions 22,23,63, rattles past the ends 36 of the webs 25,26,62.

If the closure device 1 is to be opened, the cap 5 has to be turned in the opposite direction of arrow 77 and in the process has to be moved in the opposite direction of arrow 60 relative to the cylindrical housing 3 or lifted from the latter. Consequently, when the cap 5 is turned relative to the cylindrical housing 3, the guide extensions 22,23,63 under a pretension force directed in the opposite direction of arrow 60, run onto the upper side 38 of the webs 25,26,62, and the cap is pulled out from the cylindrical housing 3 when turned further in the direction of arrow 77. If the selection of the sealing device 6, as already shown in FIG.10, has now been made in such a way that an overlap area between the sealing area 18 and the bearing area 21 in the cylindrical housing 3 is smaller than a pitch between the transverse planes 33 mounting the starts and ends 34 and 36 respectively, the inner space 42 of the cylindrical housing is cleared as long as free movement of the cap 5 in the opposite direction of arrow 60 is not possible. This prevents the stopper from being pulled suddenly out of the cylindrical housing 3 by an instantaneous, powerful tensile force in the opposite direction of arrow 60 and prevents the contents from spurting out under the resulting vacuum.

Simply for the sake of order, it should be emphasized that a groove width 78 between the webs 25,26,62 which runs perpendicularly to the longitudinal axis 7 of the cap 5 or 19 of the cylindrical housing 3 is greater than a width 79 of the guide extensions 22,23,63, as can be better seen with reference to FIGS.8 and 9. If the width 79 is selected too large, jamming can occur between the guide extensions and webs during opening and closing. This jamming can be reduced when the edges of the extensions are rounded off or these extensions are designed, for example, in the shape of a spherical segment.

FIG.14 shows an embodiment variant in which the cylindrical housing 3 is sealed by the sealing device 6 arranged in the cap 5 in the coupling part 80. The sealing device 6 is designed roughly like a bowl and has as coupling part 81 a flange-shaped locking extension 16 having a diameter 82 which is larger, roughly by twice the wall thickness 51 of the cylindrical housing 3, than a diameter 83 of a cylindrical sealing surface 18 adjoining the locking extension. The tubular cap 5 accommodating the sealing device 6 has an inside diameter which essentially corresponds to the diameter 82 of the flange-shaped locking extension 16 and thus roughly corresponds to a diameter 84 of the housing 3. In an end area of the tubular cap 5, coupling parts 81, e.g. annular extensions 86,87, are arranged so as to be spaced apart in the direction of the longitudinal axis 19 by the width 85 of the flange-shaped locking extension 16 of the sealing device, which coupling parts 81 project beyond the cylindrical inner surface of the cap 5 in the direction of the longitudinal axis 19 and define a groove-shaped locating area 88 for the locking extension 16. An inside diameter of the opening 89 of the extensions 86,87 roughly corresponds to the diameter 83 of the tubular housing 3. In a vertical plane relative to the longitudinal axis 19, guide extensions 22 arranged uniformly on the periphery, e.g. at an angular distance of 120°, project beyond the diameter 84 of the housing 3. As already described with reference to FIG.1, spiral guideways 90 on the cylindrical inner surface of the cap 5 are allocated to these guide extensions 22, which guideways 90 together form the coupling device 28 for the closure device 1 with the housing 3. To remove a medicine or a body fluid from the housing 3, the closure device 1 can be released from the housing 3 without an abrupt movement by turning the cap 5 and sealing device 6 by the same amount in opposite directions according to arrows 91,92. However, the contents of the housing 3, after the sealing device 6 has been pierced through, can also be drawn off by means of a hollow needle 93 shown by broken lines. The axial forces occurring when the hollow needle 93 is pierced through and pulled out of the sealing device 6 can here be absorbed by the flange-like locking extension 16 of the sealing device 6 and the extensions 86,87 of the cap 5. The closure device 1 is thus especially suitable for automatic blood-analysis apparatusses as frequently used in laboratories and hospitals or clinics.

By the interlocking coupling parts 80,81, namely the locking extension 16 and the groove-shaped locating area 88, a firm mounting between the cap 5 and the sealing device 6 is achieved in the direction of the longitudinal axis 19.

As can be seen further from the representation in FIG.14, recesses can be provided on the periphery of the locking extension 16 in the direction of the longitudinal axis 19, to which recesses rib-like connecting webs between the extensions 86,87 are allocated which form a toothed connection with the recesses in the locking extension 16. Thus, apart from the mounting in the direction of the longitudinal axis 19, a rotational connection is also achieved between the sealing device 6 and the cap 5, as a result of which, when the housing 3 is opened by unscrewing the closure device 1, the sealing device 6 follows the rotational movement of the cap 5 and thus any sticking of the sealing surfaces 18 on the inner wall of the housing 3 is released in such a way as to protect the sealing device 6.

FIGS.15 and 16 show another embodiment variant of the closure device 1 for a cylindrical housing 3. Here, coupling parts 94, formed by extensions 95,96 of the cap 5, are allocated to the flange-shaped locking extension 16 of the sealing device 6, which coupling parts 94 form the locating area 88 for the flange-like locking extension 16 of the sealing device 6. The extensions 95,96 are arranged so as to be distributed uniformly in an annular-segment shape on the inner periphery of the cap 5 and project in the direction of the longitudinal axis 19 and form a circular opening 89 having a diameter which roughly corresponds to the inside diameter 83 of the housing 3. The coupling parts preferably consist of four extensions 95 which are arranged at an angular distance of 90° and whose entire inner peripheral length is less than one eighth of the periphery of the circle which is circumscribed by the extensions 95 and corresponds to the inside diameter 83 of the housing 3. The radial axes 97,98 of the symmetry of the coupling parts 94 are arranged at an angular distance 99 corresponding to about 45°. The intermediate space formed by the described arrangement of the coupling parts 94 facilitates the fitting of the sealing device 6, but with the mounting of the flange-like locking extension 16 of the sealing device 6 against axial displacement as a result of an axial force acting through the adhesion force between a hollow needle 93 and the sealing device 6 being achieved.

Furthermore FIGS.17 and 18 show an embodiment variant in which the coupling part 81, designed as a flange-like locking extension 16, of the sealing device 6 is mounted in the cap 5 by finger-like extensions 100 which are distributed uniformly on the periphery, are arranged parallel to the longitudinal axis 19 of the cap 5 and serve as coupling parts 80. The tubular cap 5 has an annular shoulder 101, which project from the cylindrical inner periphery of the cap in the direction of the longitudinal axis 19, an inside diameter of the opening 89 defined by the shoulder 101 roughly corresponding to the inside diameter 83 of the housing 3, and finger-like extensions 100 connected in one piece to the cap 5. Furthermore, these finger-like extensions 100, at a distance 102 roughly corresponding to the width of the flange-like locking extension 16 of the sealing device 6, are defined by bearing surfaces 103 arranged on the shoulder 101. The flange-like locking extension 16 of the sealing device 6 is mounted between the shoulder 101 and the bearing surface 103. An opening 104 enclosed by the finger-like extensions 100 and arranged concentrically to the longitudinal axis 19 is widened in the shape of a truncated cone in the direction of a front face 105 of the cap 5 pointing away from the housing 3, a diameter 106 roughly corresponding to the outside diameter of the flange-shaped locking extension 16. By the elasticity of the material of the cap 5 or of the finger-like extensions 100 forming the coupling parts 80,81, radial elasticity of the extensions 100 is achieved. This substantially facilitates the insertion of the sealing device 6 into the locating area 88 of the cap 5, as a result of which it is also easily possible to construct the sealing device 6 from a multi-component material, e.g. having a highly elastic core and a resistant harder casing, e.g. in the area of the flange-like locking extension 16, and to press this sealing device 6, which is very resistant to axial displacement, into the locating area 88. As likewise drawn in broken line in FIG.18, the radial elasticity of the finger-like extensions 100 can be achieved or changed by a weakening in the material in the area of the shoulder 101 and by an annular spring element inserted in a groove at the outer periphery.

FIG.19 shows a further embodiment variant of a closure device 1 having a sealing device 6. The sealing device 6 has a coupling part 81, e.g. a flange-shaped locking extension 16 to which a shoulder 101 projecting from the inner surface of the cap 5 in the direction of the longitudinal axis 19 is allocated as coupling part 80. In this embodiment variant, an annular front end 107, following the insertion of the sealing device 6, is formed like a flange in the direction of the longitudinal axis 19, as drawn in broken lines in the representation. This forming can take place thermally, e.g. in the case of a cap 5 made of a thermoplastic material. This forming produces the locating area 88 for the flange-like locking extension 16 of the sealing device 6, which locking extension 16 ensures the non-displaceable positioning in the axial direction. As likewise shown further in FIG.19 by chain lines, the sealing device 6 can be axially secured by a ring 109 inserted in a groove 108 arranged in the cylindrical inner surface of the cap 5.

FIG.20 shows another embodiment variant for a closure device 1. In this arrangement, a tubular cap 5 has a cylindrical locating area 110 which is defined by the shoulder 101 at a distance 111 from the front end 107. The flange-shaped locking extension 16 of the sealing device 6 is arranged in this locating area 110. A roughly stirrup-shaped top part 112 surrounds the front end 107 of the cap 5, which top part 112 engages like a catch in receptacles 113 arranged diametrically opposite on the outer periphery of the cap 5. The top part 112 has an opening 104 which is concentric to the longitudinal axis 19 and whose diameter is smaller than the diameter of the flange-shaped locking extension 16 of the sealing device 6 and roughly corresponds to the inside diameter 83 of the housing 3. In this embodiment variant, too, it is possible to use a sealing device 6 made of a multi-component material having, for example, a hard resistant casing in the area of the flange-like locking extension 16, the top part 112, to be mounted subsequently, ensuring the axial non-displaceability of the sealing device 6, e.g. when pulling out the hollow needle 93 after removal of the contents from the housing 3.

FIG.21 shows a further embodiment variant of a closure device for a cylindrical housing 3 in which an essentially cylindrical sealing device 6 is arranged in a cap 5 for closing the cylindrical housing 3, the diameter of which sealing device 6 is slightly larger than the inside diameter 83 of the housing 3. Shoulders 101, which project from the cylindrical inner surface of the tubular cap 5 in the direction of the longitudinal axis 19 and are arranged so as to be distanced from one another and distributed on the periphery, form coupling parts 94 for the cap 5 with the sealing device 6, a distance 114 being less than the inside diameter 83 of the housing 3. Allocated to the coupling parts 94 are coupling parts 81 arranged in the circumferential surface of the sealing device 6 in a position coinciding with the coupling parts 94 and formed by recesses, as a result of which the sealing device 6 is fixed in the cap 5 both when a force acts in the direction of double arrow 115 and also against rotation about the longitudinal axis 19.

Furthermore, within the scope of the invention, it is also possible for the coupling parts to be formed by a groove, encircling in an annular manner, in the sealing device 6. In such a design, however, there is only an axial motional connection between the sealing device 6 and cap 5, i.e. this connection is not secured against rotation.

Furthermore, it is possible, to make it easier to fit the sealing device 6 into the cap 5, to form the coupling part 94 at an angle 116 and to form a front end 117 of the sealing device 6 facing the housing 3 in a cone shape.

We claim:

1. In combination with a cylindrical housing having a longitudinal axis, a closed end and an open end opposite thereto, (a) a closure cap having a coincident longitudinal axis and fitting over the open housing end, the cap including (1) a transverse end wall extending over the open housing end and defining a bore, and (2) a cylindrical shell depending from the end wall and having a concentric inner surface, (b) a sealing device arranged between the bore and the open end, the sealing device having (1) an outer cylindrical sealing surface mating with an inner cylindrical bearing surface of the cylindrical housing adjacent the open end and (2) a pierceable transverse sealing element axially aligned with the bore, (c) a tubular locking extension depending from the transverse end wall and radially engaging the sealing device and locking the sealing device to the closure cap, and (d) a coupling device arranged between the closure cap and the cylindrical housing, the coupling device including (1) two spiral webs extending on the inner surface of the closure cap shell between a first and a second transverse plane extending perpendicularly to the coincident longitudinal axis, the first plane being remote from the end wall and the second plane being close to the end wall, each web having respective ends in the first plane and second plane, the web ends in the first plane being circumferentially spaced from the web ends in the second plane by an angle of less than 180°, and (2) two guide lugs radially extending from the cylindrical housing at the open end thereof for engagement with the webs, the guide lugs being circumferentially spaced from each other by an angle of about 180°, (3) the second plane being at a distance from the transverse end wall of the closure cap which exceeds a length of the guide lugs, the guide lugs extending parallel to the longitudinal axis.

2. In the combination of claim 1, wherein the tubular locking extension is concentric with the longitudinal axis and has an inner surface aligned with the bore in the end wall, and radially inwardly extending locking ribs distributed over the circumference of the inner tubular locking extension surface.

3. In the combination of claim 2, the sealing device defines a concentric annular groove arranged to receive the tubular locking extension, the tubular locking extension being inserted in the groove and mating therewith.

4. In the combination of claim 3, the transverse sealing element is surrounded by the annular groove and seals the bore.

5. In the combination of claim 2, the ribs have sharp edges.

6. In the combination of claim 2, the ribs have end faces facing the end wall of the cap, the rib end faces extending substantially perpendicularly to the longitudinal axis.

7. In the combination of claim 1, the outer cylindrical sealing surface and the inner cylindrical bearing surface of the cylindrical housing extend parallel to the longitudinal axis.

8. In the combination of claim 1, the sealing device comprises a gas-tight rubber material at least at the sealing surface thereof.

9. In the combination of claim 1, an outer surface of the cylindrical housing is coated with a gas barrier layer extending from the closed housing end to a plane wherein the cylindrical sealing surface mates with the cylindrical bearing surface.

10. In the combination of claim 1, the sealing device has a highly elastic core surrounded by the cylindrical sealing surface of a rigidity higher than that of the core.

11. In the combination of claim 10, the sealing device core has a rigidity of 43° Shore and the rigidity of the sealing surface is higher than 43° Shore.

* * * * *